US008471815B2

(12) United States Patent
Jaouen

(10) Patent No.: US 8,471,815 B2
(45) Date of Patent: Jun. 25, 2013

(54) JOYSTICK WITH COMPENSATION SPRINGS AND CORRESPONDING METHOD OF MANUFACTURE AND CONTROLLER

(75) Inventor: Jean-Yves Jaouen, Saint Jean la Poterie (FR)

(73) Assignee: Guillemot Corporation, S.A., Chantepie Cedex (FR)

( * ) Notice: Subject to any disclaimer, the term of this patent is extended or adjusted under 35 U.S.C. 154(b) by 0 days.

(21) Appl. No.: 12/983,786

(22) Filed: Jan. 3, 2011

(65) Prior Publication Data

US 2011/0163957 A1 Jul. 7, 2011

(30) Foreign Application Priority Data

Jan. 4, 2010 (FR) ..... 10 50018

(51) Int. Cl.
*G09G 5/08* (2006.01)

(52) U.S. Cl.
USPC ..... 345/161; 345/156; 463/38

(58) Field of Classification Search
USPC ..... 345/161, 156, 157; 273/148 B; 200/4, 200/5 R–5 F, 6 A; 74/471 R–471 XY
See application file for complete search history.

(56) References Cited

U.S. PATENT DOCUMENTS 4,404,991 A * 9/1983 Cullen ..... 137/636.1
4,439,648 A * 3/1984 Reiner et al. ..... 200/6 A
5,691,517 A * 11/1997 Yamamoto et al. ..... 200/6 A
5,952,631 A * 9/1999 Miyaki ..... 200/6 A
6,538,639 B1 * 3/2003 Takahashi ..... 345/161
6,606,085 B1 * 8/2003 Endo et al. ..... 345/161
6,618,036 B1 * 9/2003 Tanaka ..... 345/161
6,654,005 B2 * 11/2003 Wang ..... 345/161
6,667,734 B2 * 12/2003 Furukawa et al. ..... 345/161
7,030,324 B2 * 4/2006 Gotoh ..... 200/6 A
7,199,314 B2 * 4/2007 Huang et al. ..... 200/6 A
7,679,011 B2 * 3/2010 Chang ..... 200/6 A
7,753,077 B2 * 7/2010 Bertolasi et al. ..... 137/636.2
7,821,500 B2 * 10/2010 Wedel et al. ..... 345/169
8,039,767 B2 * 10/2011 Saomoto ..... 200/6 A
2002/0005833 A1 * 1/2002 Furukawa et al. ..... 345/161
2003/0103217 A1 * 6/2003 Gombert ..... 356/614
2004/0129899 A1 * 7/2004 Gombert ..... 250/548
2006/0279535 A1 * 12/2006 Chang ..... 345/156
2007/0163861 A1 * 7/2007 Downer ..... 200/6 A
2007/0164996 A1 * 7/2007 Gould ..... 345/161
2008/0227547 A1 * 9/2008 Nourry ..... 463/38
2008/0257090 A1 * 10/2008 Bertolasi et al. ..... 74/471 XY
2008/0280640 A1 * 11/2008 Wedel et al. ..... 455/556.1
2009/0295724 A1 * 12/2009 Cheng et al. ..... 345/161
2010/0173711 A1 * 7/2010 Jaouen ..... 463/38

* cited by examiner

*Primary Examiner* — Dmitriy Bolotin
(74) *Attorney, Agent, or Firm* — Blakely Sokoloff Taylor & Zafman LLP

(57) ABSTRACT

A joystick biased to return its stick to a neutral position and with compensation of the force applied by the biasing. The joystick has a stick that is moveable in relation to a base at least in rotation around two axes and biasing element mounted between said base and a movable element acting on said stick, tending to return said stick to a neutral position. The joystick further comprises compensator, mounted between the base and the movable element, and applying on the latter a force to compensate at least partially the force applied by the biasing, at least when said stick is located in the vicinity of said neutral position.

10 Claims, 4 Drawing Sheets

JOYSTICK WITH COMPENSATION SPRINGS AND CORRESPONDING METHOD OF MANUFACTURE AND CONTROLLER

FIELD OF THE INVENTION

The field of the invention is that of equipment and accessories for interactive leisure activities for micro-computers and game consoles.

More precisely, the invention relates to joysticks, and accessories implementing a joystick. The term "joystick" also encompasses the devices known as "control sticks" or "flight sticks", as well as similar devices of reduced size, sometimes referred to a "mini-sticks", and which can be mounted for example on a controller.

BACKGROUND

Joysticks have been known for several decades. Diagrammatically, they include a base, whereon is mounted a stick that can be moved in two directions x, y, defining a plane parallel to the base, and perpendicular to the axis $z_{neutral}$ defined by the stick when it is idle.

Means of detecting and measuring movement are provided in the base. As such, the movements applied to the stick by a user are detected, then generally converted into digital signals and transmitted by a wire or wirelessly to a device for processing data, such as a computer or a game console, so that the latter interprets these movements of the stick according to the software used.

Several techniques for detecting movement have been proposed. In particular, at the origin, four contacts were used, distributed in the shape of a cross according to the axes x and y. Today several techniques are used making it possible to define more precisely the position of the stick in relation to the base, for example based on potentiometers or Hall effect sensors, allowing for a detection of position without contact.

Joysticks include return means, tending to return the stick to a central position, or neutral position, when no effort is applied on the latter. This can in particular entail a helical spring acting on a part integral with the stick and mobile in the base. Different mounting alternatives of such a spring are shown for example in DE-10 2005 012 883, U.S. Pat. No. 5,891,462 or US-2007/026959.

Generally, the assembly of the spring, and therefore the parts whereon it presses against, are defined in such a way as to provide a sufficient resistance, but not too substantial, when the controller is displaced by the player, in particular in positions of maximum inclination, in relation to the axis of the stick in the neutral position (referred to as neutral axis, axis $z_n$ or axis $z_{neutral}$). Another major aspect is that the spring must guarantee a quick and precise return in the neutral position, when the stick is released, without imprecision around the neutral position, or rebound effect around this position.

In order to satisfy these requirements, the spring must have a sufficiently high tension. However, the latter can cause problems of precision, and/or of feeling, in the manipulations carried out by the user, in particular when the latter wants to carry out movements of low amplitude, in the neighbourhood of the neutral position (also referred to as the idle position). Indeed, in this zone, the force applied by the spring is felt substantially, and is sometimes a hindrance in manipulating the stick. It is however not possible to reduce the force applied by the spring, as the latter is required in order to effectively return the stick to neutral position, when the stick has been highly inclined.

Moreover, the prior art joysticks encounter rebound problems around the neutral position of the stick when the user suddenly releases the stick, in particular because of the high tension of the spring. The rebound effect occurs, for example, if the stick is in the vicinity of the neutral position and the user releases the stick suddenly.

OBJECTIVES OF THE INVENTION

The invention in particular has for objective to overcome these disadvantages of prior art.

More precisely, an objective of the invention is to provide a joystick offering a precision and/or a feeling during use that is improved.

As such, according to at least one embodiment, an objective of the invention is to provide such a joystick, making it possible to act accurately, comfortably and in an ergonometric manner on the stick of the joystick, in particular when the latter is located in the neighbourhood of the neutral position.

Another objective of the invention, according to at least one embodiment, is to provide such a joystick of which the encumbrance is relatively reduced.

Yet another objective, according to at least one embodiment of the invention, is to provide such a joystick that is simple to assemble, and/or which uses a limited number of parts to assemble in relation to prior art.

Another objective of the invention is to provide, according to at least one embodiment of the invention, a joystick which can be used with a handle, whatever the weight of this handle, while also offering a better aptitude for handling, a better manoeuvrability, including in the vicinity of the neutral position.

Another objective of the invention is to provide, according to at least one embodiment of the invention, a joystick which reduces the rebound effect in the vicinity of the neutral position.

SUMMARY OF THE INVENTION

These objectives, as well as others which shall appear in what follows, are achieved using a joystick comprising a stick that is moveable in relation to a base at least in rotation around two axes and first return means mounted between said base and a movable element acting on said stick, tending to return said stick to a neutral position.

According to the invention, the joystick further comprises means of compensation, mounted between said base and said movable element, and applying on the latter a force compensating at least partially the force applied by said first return means, at least when said stick is located in the vicinity of said neutral position.

These means of compensation, which can, according to the configurations, ensure a total or partial compensation, thus making it possible to limit, and even cancel, the force applied on the stick by the first return means, in particular when the stick is in a zone close to the neutral position. As such, the user can act finely and precisely on the stick, in this zone. The joystick therefore offers the user a better feeling, without harming the effectiveness of the first return means.

Moreover these means of compensation allow a reduction of the rebound effect in the vicinity of the neutral position. For example, if a user suddenly releases the stick, the means of compensation absorb the rebound.

Furthermore, the means of compensation allow a reduction of the mechanical looseness. The user doesn't perceive any looseness thanks to these means of compensation.

A joystick according to the invention also allows, thanks to the presence of the means of compensation, a use of this joystick with a handle mounted on the stick, whatever the weight of this handle. Indeed, a joystick which is provided with a heavy handle, for example a handle made of metal (in particular, made of steel), requires the use of first return means which provide with a high return force, in order to return the stick to a neutral position. Moreover these return means must be powerful enough to avoid the joystick pivoting spontaneously under the influence of its own weight.

The means of compensation make possible to ease the weight of the unit which is composed of the stick and the handle, by compensating fully or in part the forces exerted by the first return means in the vicinity of the neutral position. As a consequence, the user of such a heavy joystick including the means of compensation according to the invention can easily handle the joystick, in particular in the vicinity of the neutral position despite the use of powerful first return means.

According to a particular embodiment, said means of compensation include second return means, mounted between said base and said movable element, and applying on the latter a force partially compensating the force applied by said first return means.

This approach is relatively simple to implement, and is effective in practice. In particular, said second return means can include at least one secondary helical spring.

As such, when said movable element is a moveable support in translation parallel to the neutral axis of said stick, acting on a part integral with said stick, and that it is mounted on columns parallel to the neutral axis of said stick, each of said columns can carry a secondary helical spring on each of said columns.

The assembly is then very simple, the second springs being simply threaded on the columns.

According to a particular embodiment of the invention, the joystick comprises at least one ball and socket joint comprising two elements of a ball and socket joint substantially of the same radius, i.e. a head and a small cup, with one of the elements able to pivot around the centre of the other element, a first of said ball and socket joint elements being fixed in relation to said base and having an inside space, and a second of said ball and socket joint elements being integral with said stick, and in contact with said movable element.

In particular, said stick can have an extension penetrating into said inside space, the lower end of said extension of said stick being displaced in said inside space and carrying at least one sensor and/or at least one magnet of a unit for detecting movement by Hall effect.

As such, either the head, or the small cup, has an opening wherein penetrates an extension of said stick. The "head" and the "small cup" (these terms are used by analogy for example with the field of prostheses) define a ball and socket joint. However, either the head is open, in such a way as to allow for the displacement of the extension of the stick, inside this head; or the small cup is open, in such a way as to allow for the displacement of the extension of the stick, inside this small cup.

In other terms, the joystick comprises at least one ball and socket joint comprising two ball and socket joint elements substantially of the same radius, i.e. a head and a small cup, with one being able to pivot around the centre of the other, a first of said ball and socket joint elements being fixed in relation to said base and having an inside space, and a second of said ball and socket joint elements being integral with said stick, and an extension of said stick penetrates into said inside space, the lower end of said extension of said stick displacing in said inside space and carrying at least one sensor and/or at least one magnet of a unit for detecting movement by Hall effect.

The inside space is therefore a free space, inside of which the lower end of the stick is displaced. It is circumscribed in a sphere, defined by the contour of the ball and socket joint, and in particular of the head (in other terms, the lower end of the stick is displaced in a free zone inside the ball and socket joint, and not under the latter).

The lower end of the stick, and the detection element (or elements) that it carries, can in particular be placed, idle, substantially at the centre of this sphere (therefore at the centre of the head) in order to allow for substantial displacement. The complementary detection element (or elements), fixed in relation to the base, can also be housed inside the ball and socket joint.

This structure allows for a simple and compact assembly, and an effective measurement of displacements, and for example of the magnetic fields, if a detection via the Hall effect is implemented.

According to a particular implementation, the joystick comprises a tipping part mounted pivotingly in said inside space on two bearings, and cooperating with said extension.

This approach makes it possible to provide an effective control of this displacement of the end of the stick.

The invention further relates to a method of manufacture of a joystick such as described hereinabove. Such a method comprises in particular the following steps:

obtaining a lower portion of said base;

setting up said first return means or said means of compensation;

setting up said movable element;

setting up said means of compensation or said first return means;

closing said base, in relation to an upper portion of said base and attaching of the latter to said lower portion.

The invention also relates to game controllers, and more generally similar accessories, comprising at least one joystick such as described hereinabove.

BRIEF DESCRIPTION OF THE DRAWINGS

Other characteristics and advantages of the invention shall appear more clearly when reading the following description of a preferred embodiment of the invention, provided as a simple example that is not limited, and of the annexed drawings, among which.

DETAILED DESCRIPTION

The invention thus relates to a new joystick, relatively simple to manufacture and having high precision and offering a good feeling for users, in particular in the neighbourhood of the neutral position.

The embodiment described hereinafter relates to a Hall effect joystick. It is clear however that other types of joysticks can implement, advantageously, the solution of the invention.

The following therefore is a description of an example of the mechanical system of the invention, in the form of a module which can then come to dress, using exterior design elements, for example, in the case of a "joystick", using a base and a handle which has an ergonomic covering (this handle can be screwed to the upper portion of the stick hence the handle is removable). This base and this handle can carry different complementary elements, such as means of interfacing (buttons, actuators, potentiometers, etc.), means for processing and transmitting signals, means for restoring information (indicators, vibrators, force feedback, etc.), ballast elements, etc.

Such a module according to the invention can also be set up, where applicable in several copies, on a game controller.

The claims relate to the modules such as described in what follows as such, and also the joysticks, controllers, or other similar accessories, incorporating one or several modules.

Figure 1:
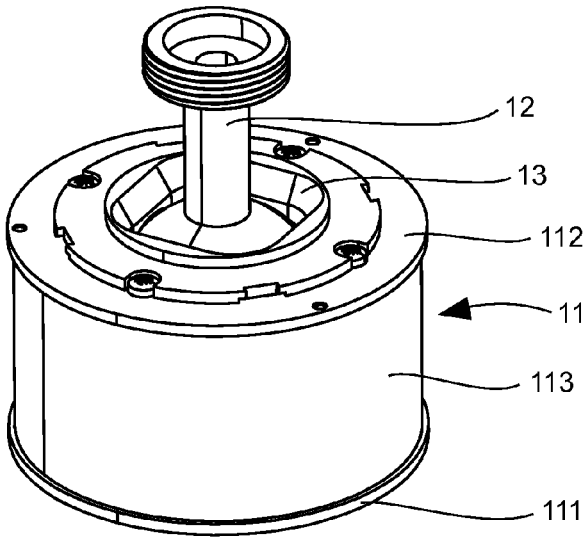
FIG. 1 shows an example of a joystick module according to the invention, according to a first embodiment.

FIG. 1 diagrammatically shows such a module. It comprises a base, or base element, 11, formed of a lower capsule 111, of an upper capsule 112 and of a lateral wall 113. The capsules are for example made of stainless steel.

A stick 12 can be displaced in relation to base 11, in the plane x, y. For this, an opening 13 is arranged in the upper capsule 112.

In what follows, axis z refers to the axis defined by the stick 12. When it is in its idle position, or neutral position, this axis is referred to as $z_n$, or $z_{neutral}$. This axis $z_n$ is perpendicular to the plane x, y.

Figure 2:
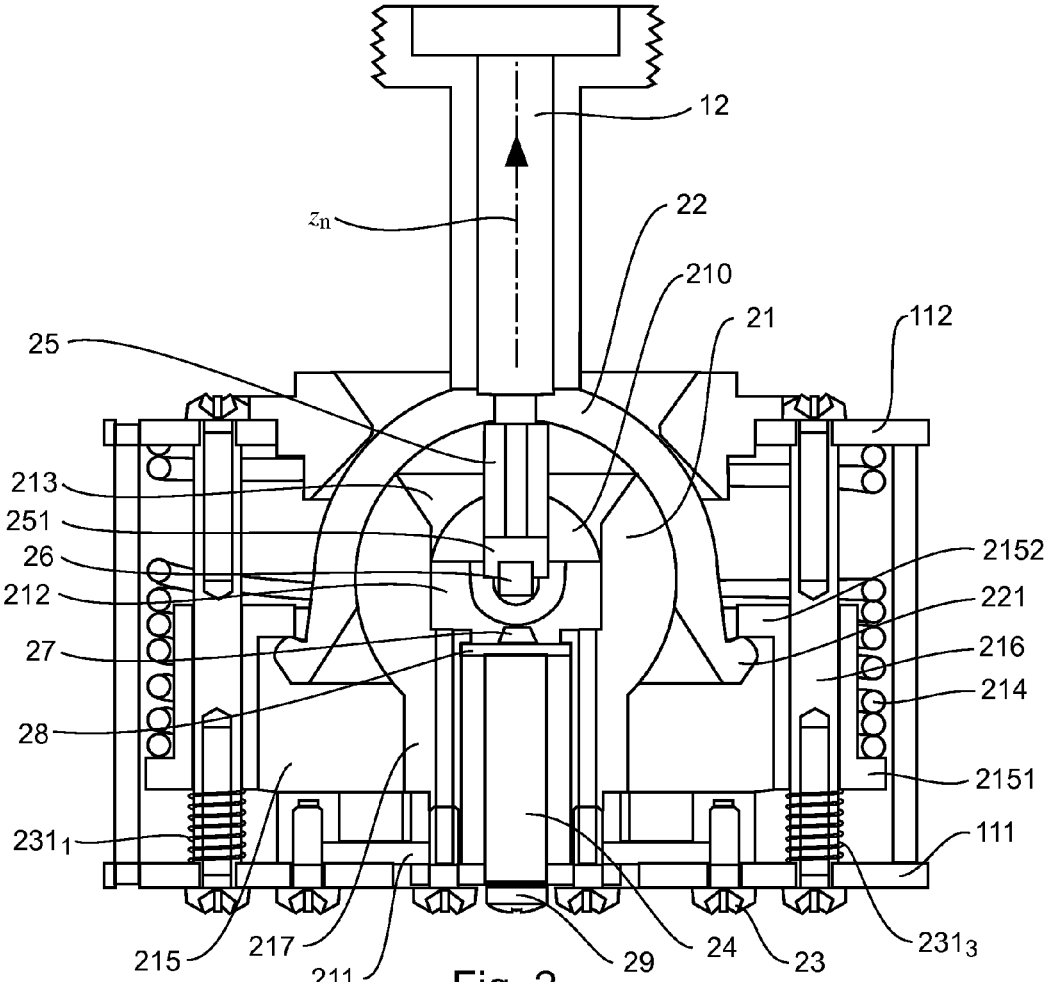
FIGS. 2 and 3 are two cross-section views, respectively according to the axes x and y, of the module in FIG. 1.
Figure 3:
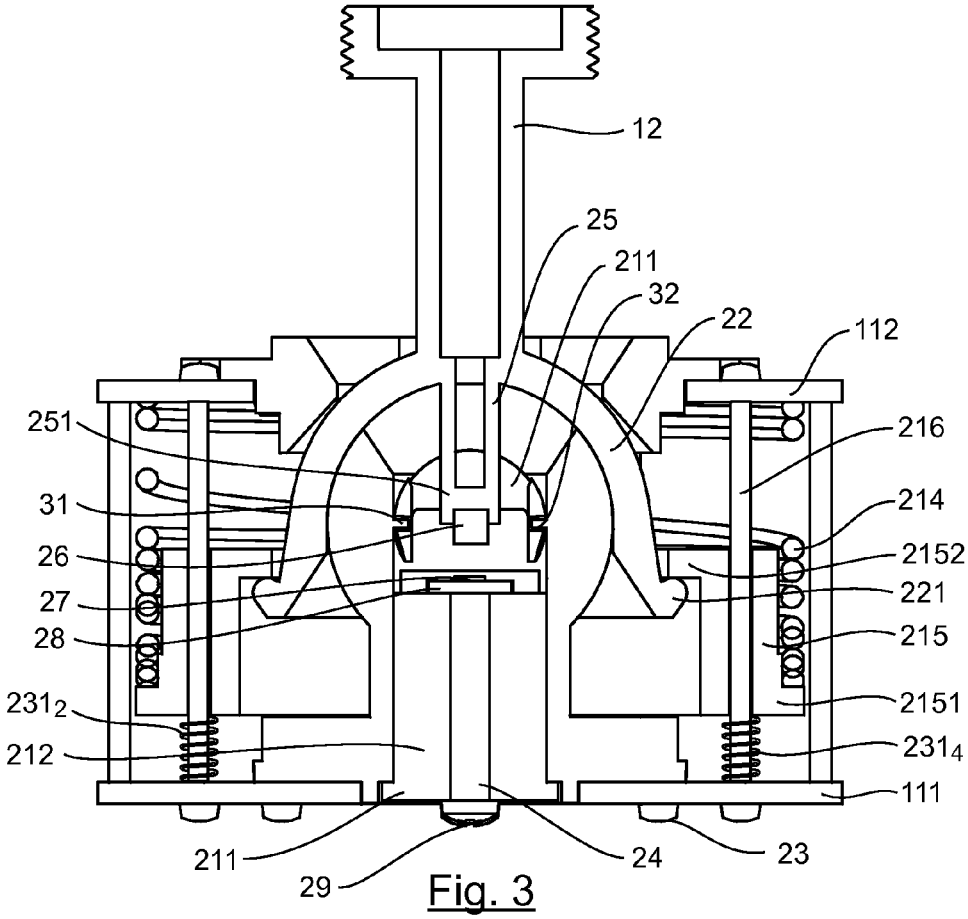

As it is shown in the cross-section views in FIGS. 2 and 3, which correspond respectively to cross-sections according to two perpendicular axes x and y, the module comprises a fixed head 21, whereon small cup 22 presses against. This head 21 and this small cup 22 form a ball and socket joint, the small cup is able to pivot around the centre of the head.

The head 21 is formed from a part (made for example from polyoxymethylene (POM) loaded with Teflon (registered trademark)) having a connection zone 211 with the lower capsule 111, and a linking zone, for example cylindrical, 217 extending between the head properly speaking (i.e. the partially spherical surface whereon the small cup presses against) and the connection zone 211.

The attaching of the connection zone 211 with the lower capsule 111 is provided for example using a screw 23. It could also be carried out for example by gluing, and even be directly moulded or overmoulded on the lower capsule 111.

The small cup, or dome, 22, is mounted on the stick 12, in such a way as to control, in the form of rotations, the displacements applied by the user to this stick.

An extension 25 is formed in the extension of the stick 12, in order to extend according to the axis z, inside the small cup 22.

The part formed by the stick 12, the small cup 22 and the extension 25 can be formed, for example by moulding or overmoulding, in the same part. The stick and its extension can be hollow, which makes possible in particular the passage of electric wires and the placement of a connector at the upper end of the stick.

This part can in particular be made of polyamide (PA 45% CFV for example).

The head 21 therefore has a tapered spherical shape in its upper portion, which has an expanded opening 213, inside of which can penetrate the extension 25. The dimensions and the edges of this opening 213 can be advantageously adapted to serve as stops to the extension 25, in the positions of extreme inclination of the stick 12.

The opening 213 in the head 21 is extended by a substantially cylindrical zone 212, inside of which is displaced the end 251 of the extension 25, which is provided with a magnet 26. The opening 213 and the cylindrical zone 212 define an inside space of the ball and socket joint (and here of the head), inside of which penetrates the extension 25, in such a way that its end 251 in particular, and therefore the magnet 26, is displaced inside this inside space. It is therefore observed that the displacement of this magnet 26 is carried out inside the head 21, and in particular that the inside space 212 is circumscribed in a sphere defined by the surface of the head 21, when it is extended fictively.

At the bottom of the zone 212, is mounted a Hall effect sensor 27, which is for example a triaxial sensor, such as proposed by the Melexis company (registered trademark).

As such, according to this embodiment, the unit for measuring by the Hall effect (magnet 26 and sensor 27) is housed inside the ball and socket joint, i.e. the sphere defined by the surface of the head 21.

This Hall effect sensor 27 is mounted on a printed circuit 28, or PCB, integral with the head 21. The presence of a triaxial, or 3D, sensor makes it possible to obtain very good precision.

According to an advantageous embodiment, the space extending under this printed circuit 28, from the lower capsule 111, is a free space 24, that can be accessed in particular for the adjustments and the calibration of the sensor 27 and/or for the passage of cables. A part 29 (for example a screw or a cover) can then be added in this space 24, in order to close it off.

Figure 4:
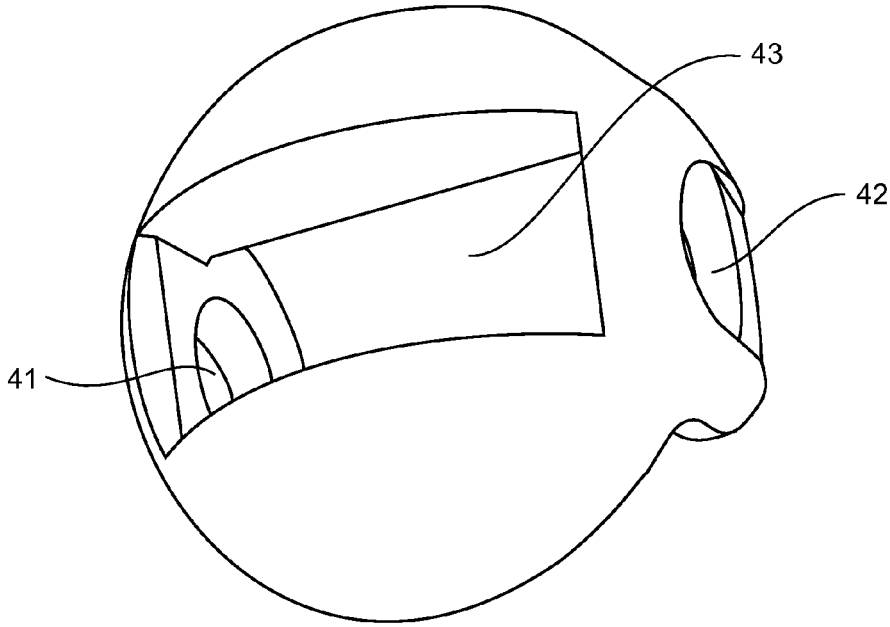
FIG. 4 is a perspective view of the tipping part which can be seen in FIGS. 2 and 3.

In such a way as to prevent the stick 12 from rotating around itself, a tipping element 210 can be provided, which makes it possible for the stick 12 to tip in the desired directions, but does not rotate around itself, around the axis z. An example of this tipping part 210, which can also assist in preventing variations in height of the magnet 26, is more precisely shown in FIG. 4.

It comprises on the one hand two circular openings 41 and 42, able to cooperate with two bearings 31, 32, formed in the head 21. These bearings allow for the tippings in a direction x (if it is considered that the bearings extend according to the axis y).

According to this axis y, the tipping part 210 further comprises an oblong opening 43, inside of which can be displaced the extension 25, according to the axis y.

As such, thanks to this tipping part 210, it is possible to control the tipping of the stick 12 according to the two axes x and y, and therefore in the plane (x, y), without the stick 12 rotating around its axis z.

This part can in particular be made of polyamide (PA 45% CFV for example).

Of course, this tipping part could be carried out in a substantially different manner, by still authorising two degrees of freedom in rotation, for example in the form of a Cardan joint of which one of the forks is fixed to the fixed spherical head and the other to the extension of the stick.

The fact that the magnet 26 is placed, for example by embedding, at the end 251 of the extension, allows for a direct transfer of the movement of the stick, without any mechanical intermediary.

Details on the calculation of the positioning of this magnet, carried out by the sensor 27, which is known per se, will not be provided. The sensor 27, which can be a sensor available in commerce, delivers a digital signal that represents this position.

It is understood that the structure proposed, wherein the measurement between the magnet 26 and the sensor 27 is direct, without any mechanical intermediary, makes it possible to obtain great precision, and in particular to take into account small displacements, and this, regardless the position of the stick 12. This also makes it possible to overcome the possible presence of so called "dead" calculation zones, which could appear for example because of looseness.

First return means, here in the form of a pre-compressed helical spring 214, make it possible to automatically return the stick 12 to its neutral position (according to the axis $z_n$), at the least displacement imparted to the latter.

The spring 214 acts on a spring support, called in what follows a moveable support 215 (made for example from polyoxymethylene (POM) loaded with Teflon (registered trademark)), guided in translation in the module, according to the axis $z_n$, for example using four columns 216, which can in particular be made of stainless steel. The spring is placed along these four columns, then compressed by the upper capsule 112. It acts on a lower edge 2151 of the moveable support, tending to push the latter downwards.

The moveable support 215 further has an upper edge, or shoulder, 2152, which comes to press against an edge 221 of the small cup, extending towards the exterior (in opposition to the inside of the small cup). The edge 221 of the small cup and/or the shoulder 2152 of the moveable support can have forms and surfaces adapted to cooperate together, and tend to return the stick to its neutral position.

It is understood indeed that, when the stick 12 is inclined in one direction, the small cup 22 is displaced in rotation around the head 21, causing the displacement upwards of its edge 221, on the side opposite the direction imparted to the stick. The edge 221 acts on the shoulder 2152, which tends to raise the moveable support 215, which slides along columns 216.

The spring 214 opposes this displacement. As such, as soon as the user releases the stick, the spring 214 returns the moveable support 215 to its idle position. The latter acts on the small cup 22, also to return it in an idle position, which corresponds to the return to the neutral position of the stick 12.

In order to limit the wear between the shoulder 2152 and the edge 221 of the small cup, it can be provided for example to overmould a piece of sheet metal on the shoulder 2152.

In order to offer a better feeling to the user of a joystick according to the invention, around the neutral position of the stick, i.e. when the stick is located in positions close to this neutral position, means of compensation, or balancing, can moreover be provided. Indeed, this neutral position, or central position, generally requires great precision. As specified in what follows, the expression "means of compensation" refers to means compensating totally or partially the force of the main spring 214. In the preferred embodiment described hereinafter, this compensation is partial, in such a way that the joystick is more flexible near the neutral position, but that the resulting force even so effectively brings back the stick to neutral position when the user releases it.

According to the embodiment described, means of compensation of forces exerted by the main spring 214 (or first return means) are provided, in the form of second return means placed between the base 11, and more precisely the lower capsule 111, and the moveable support 215.

Figure 5:
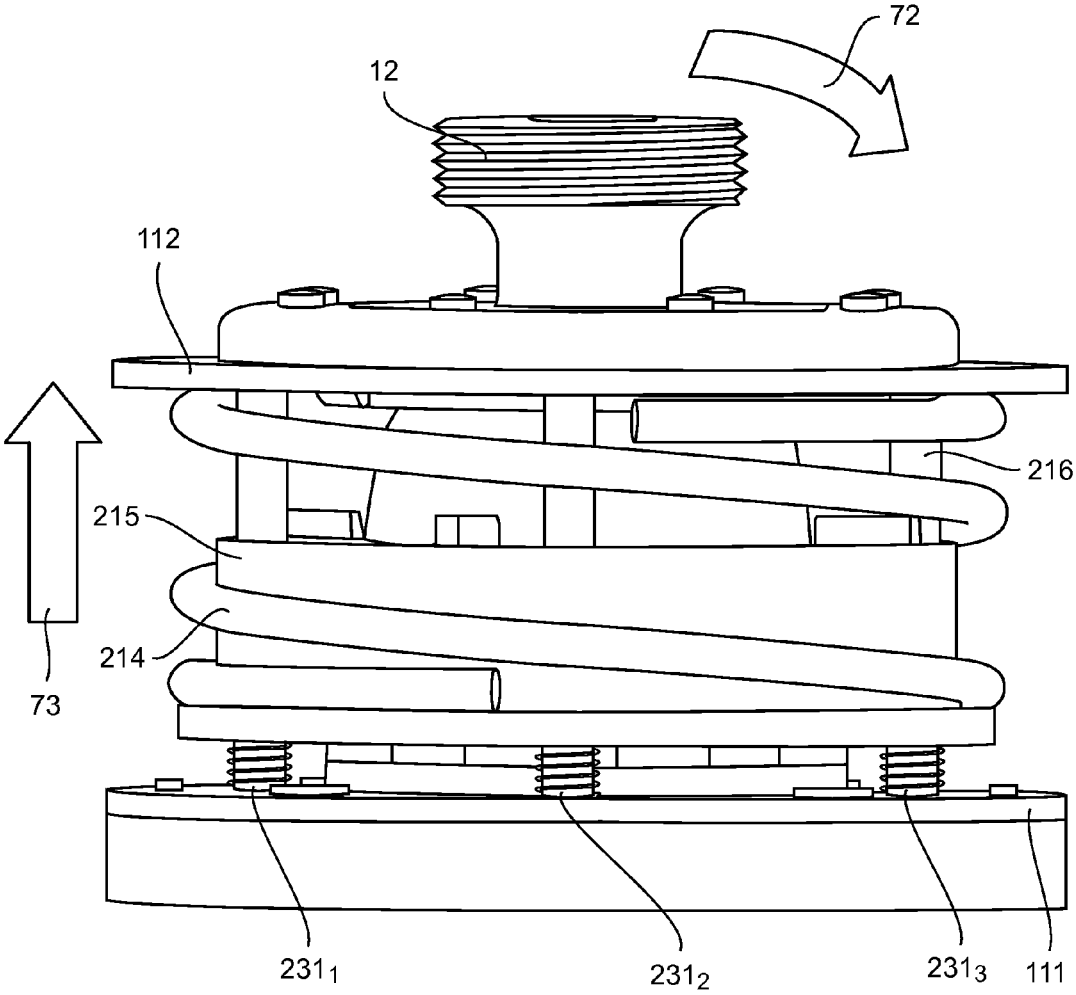
FIG. 5 shows a joystick according to FIGS. 1 to 3, without its lateral wall, in such a way as to distinguish the various return means.

These second return means include four helical springs, also referred to as secondary springs $\mathbf{231}_1$, $\mathbf{231}_2$, $\mathbf{231}_3$, $\mathbf{231}_4$ (of which three, numbered $\mathbf{231}_1$, $\mathbf{231}_2$, $\mathbf{231}_3$ can be seen in FIG. 5, two, numbered $\mathbf{231}_1$ and $\mathbf{231}_3$ can be seen in FIG. 2 and two others, numbered $\mathbf{231}_2$ and $\mathbf{231}_4$ can be seen in FIG. 3), mounted on the four columns 216. According to other implementations, this can entail spring leafs, or elastic means more generally, placed adequately between the lower capsule 111 and the moveable support 215.

When the stick 12 is inclined, for example by a rotation around the head of the ball and socket joint according to the arrow 72, the moveable support 215 moves away from the lower capsule 111, according to the arrow 73. This displacement results in the compression of the main spring 214. The secondary springs $\mathbf{231}_1$, $\mathbf{231}_2$, $\mathbf{231}_3$, $\mathbf{231}_4$ are then expanded and have little influence.

However, in the central zone, i.e. in the vicinity of the idle position), the secondary springs $\mathbf{231}_1$, $\mathbf{231}_2$, $\mathbf{231}_3$, $\mathbf{231}_4$ are compressed to the maximum, tending to compensate fully or in part the forces exerted on the moveable support 215 by the main spring 214. The result of the forces applied by this main spring 214 and the secondary springs $\mathbf{231}_1$, $\mathbf{231}_2$, $\mathbf{231}_3$, $\mathbf{231}_4$ which are opposed is therefore reduced, in relation to the force of the main spring alone. This makes possible movements that are much more flexible in the central zone, and therefore a better feeling for the user.

According to a favourable embodiment of the invention, the stick 12 is provided with a threaded portion which allows fixing a handle on the stick, in particular a handle made of metal. Obviously, according to other embodiments, the handle can be fixed on the stick 12 by other fixing means, for example by gluing, by Velcro (registered trademark), by clipping, by fitting the handle to the stick or by equivalent means. Such a joystick, provided with a handle made of metal or an other equivalent heavy material, is likely to entail a heavy weight which requires a powerful main spring 214 in order to avoid that the unit composed of the stick and the handle pivots spontaneously under its own weight, and in order to ensure that the stick returns efficiently to the neutral position.

The invention makes possible to ease the weight of the unit composed of such handle and the stick (the stick may also be made in whole or in part of metal such as steel for example), by using means of compensation which enable to compensate fully or in part the forces exerted by the main spring in the vicinity of the neutral position. As a consequence, the user of such a heavy joystick including the means of compensation according to the invention can easily handle the joystick, in particular in the vicinity of the neutral position despite the use of a powerful first main spring 214. The invention has been successfully tested with a handle whose weight is about 1 kg (for the sake of clarity, this weight doesn't include the weight of the stick).

The springs (main spring and secondary springs) are chosen in such a way as to provide the desired compromise between the comfort (which supposes a result of the forces that is relatively low), and a precise and effective return to neutral position (which supposes a result of the forces that is sufficient). A good feeling for the users is the result of a compromise. Users do not necessarily appreciate having a joystick that is too flexible in the vicinity of its central position, therefore the balancing or the quasi-balancing of the forces is not necessarily a good compromise. This good compromise will be for example obtained via successive tests, taking into account the feedback from a majority of users and/or according to the reactions of flight simulator enthusiast testers.

In a preferred embodiment, a circular elastomer strip is arranged between the moveable support 215 and the small cup 221. This circular strip is glued on the moveable support 215 under the shoulder 2152 and cooperates with the edge 221. This circular elastomer strip can be a BUMPON strip (registered trademark). This elastomer strip has also a function of pushing the moveable support 215 upwards, even though this pushing is less than the one operated by the secondary springs 231.

Figure 6:
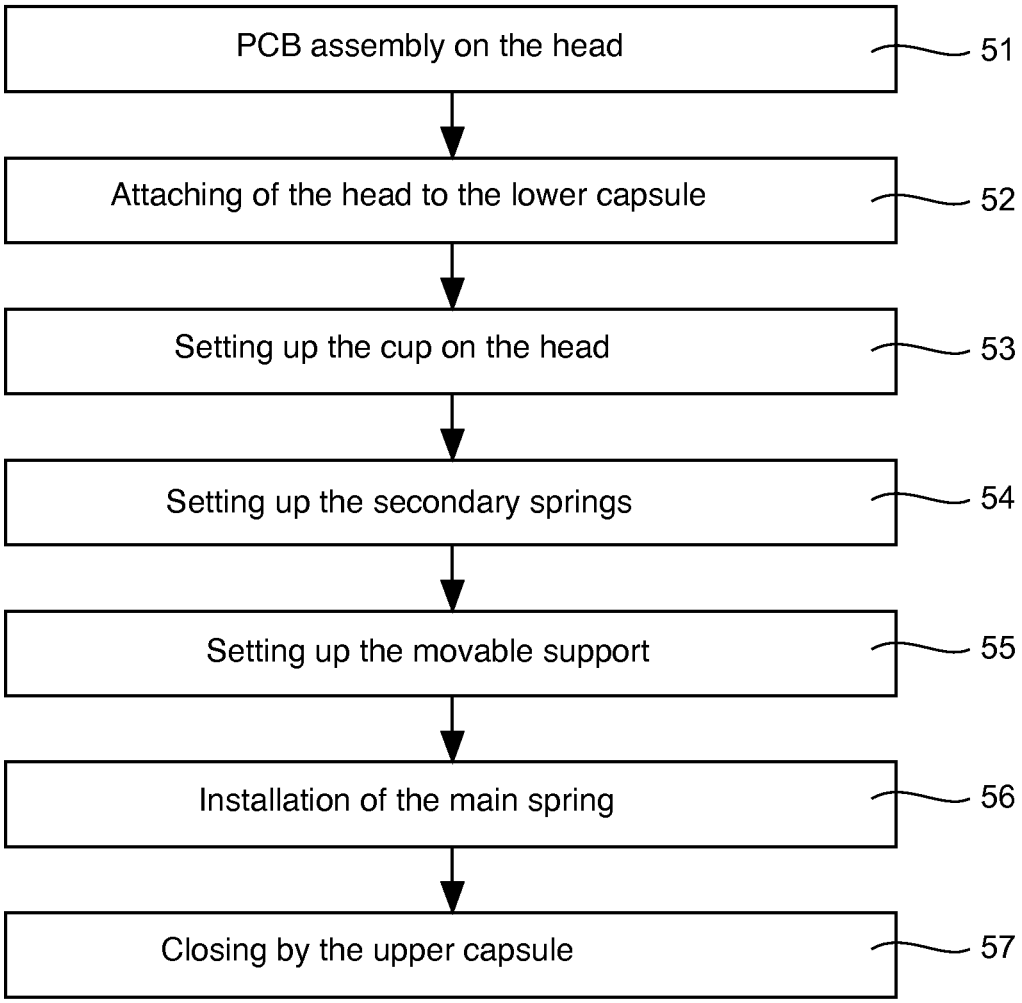
FIG. 6 diagrammatically shows the main steps in the assembly of a module such as is shown in FIGS. 1 to 4.

The assembly of such a joystick is relatively easy, in particular in relation to prior art. FIG. 6 diagrammatically shows an example of an assembly method, in the form of a simplified block diagram, showing the main steps.

As such, an assembly (51) is first carried out of the PCB 28 (whereon has been welded beforehand the sensor 27 and the required electric cables) on the head 21, in a housing provided for this purpose. The attaching can be carried out for example by clipping and/or gluing. The electric cables are placed in the open space under the PCB.

Then, the head 21 is attached (52) to the lower capsule 111, for example by screwing. It was possible, beforehand, to pre-equip the lower capsule, in particular with the lateral wall 113 and the columns 216.

The stick 12, provided with its small cup 22 and its extension, whereon the magnet 26 has been fixed, for example by clipping and/or gluing, is then set in place (53), in such a way that the small cup 22 covers the head 21. The end of the extension is placed in the oblong opening of the tipping part 210, mounted beforehand on the bearings of the head.

A setting in place (54) is then carried out of the secondary springs $\mathbf{231}_1$, $\mathbf{231}_2$, $\mathbf{231}_3$, $\mathbf{231}_4$, on the columns 216, then a setting in place (55) is carried out of the moveable support 215, on the columns 216, which were mounted beforehand, for example by screwing, on the lower capsule 111. This moveable support can freely slide along columns. The shoulder 2152 of this moveable support comes into contact with the edge 221 of the small cup.

Then an adding (56) of the main spring 214 is carried out on the moveable support 215, and a closing (57) is carried out on the base, using the upper capsule 112, which is for example screwed on the columns. This action simultaneously results in the compression of the spring 214 (between the upper capsule and the moveable support) and the compression of the secondary springs $\mathbf{231}_1$, $\mathbf{231}_2$, $\mathbf{231}_3$, $\mathbf{231}_4$ (between the moveable support and the lower capsule).

It is then possible to be able to carry out the adjustments and the calibrations of the sensor, then add to the unit obtained as such the dressing at the additional functions required according to the applications.

According to another embodiment of the invention, the main spring can be mounted compressed between the lower capsule and the moveable support, which is therefore pushed upwards. In this case, the secondary springs are mounted in such a way as to push the moveable support downwards.

According to other alternatives of the invention, it is possible to inverse the small cup and the head. In this case, the small cup defines a fixed container, integral with the base, wherein the head comes to press against, integral with the stick. An extension, carrying a magnet, respectively a sensor, penetrates into the small cup, in order to cooperate with a sensor, respectively a magnet, housed at the bottom of the small cup.

The secondary helical springs are not necessarily mounted on the columns 216 (which can moreover be absent), in certain embodiments. Housings or adequate supports can be defined, in or on the base or an element integral with the base and/or in or on the moveable support.

According to an alternate implementation, a single secondary helical spring, placed in a centred manner in relation to the axis $z_{neutral}$, can be provided, mounted for example between the columns. This single secondary spring is then concentric with the main spring, but shorter and/or of a lesser stiffness than the latter.

Moreover, other return means, such as spring leafs, can be used. Elastic elements, for example made of elastic plastic material can also be placed between the moveable support and the base.

In certain embodiments, the means of compensation can be movable, for example in order to allow the player to retain them or not, or to replace them with means of compensation of which the force is different, according to his expectation and/or the games that he uses.

In other embodiments, these means of compensation can be adjustable, in order to allow for fine adjustment and balancing during the manufacture and/or to allow the player to adjust the reactions of the joystick according to his expectations and needs. As such, in the case of helical springs, a movable part is provided, for example by screwing, making it possible to compress each spring more or less.

The invention claimed is:

1. Joystick comprising a stick (12) movable in relation to a base (11) at least in rotation around two axes, and first return means mounted between said base (11) and a movable element acting on said stick (12), tending to return said stick (12) to a neutral position, characterized in that it comprises means of compensation, mounted between said base (11) and said movable element, and applying on the latter a force compensating at least partially the force applied by said first return means, at least when said stick (12) is located in the vicinity of said neutral position such that less force is required to move the stick near the neutral position than in the absence of the means of compensation.

2. Joystick according to claim 1, characterized in that said means of compensation include second return means, mounted between said base and said movable element, and applying on the latter a force partially compensating the force applied by said first return means.

3. Joystick according to claim 2, characterized in that said second return means include at least one secondary helical spring.

4. Joystick according to claim 3, characterized in that said movable element is mounted on columns (216) parallel to the neutral axis of said stick (12), and in that each of said columns carries a secondary helical spring.

5. Joystick according to claim 1, characterized in that said movable element is a moveable support in translation parallel to the neutral axis of said stick (12), acting on a part integral with said stick (12).

6. Game controller, characterized in that it comprises at least one joystick according to claim 1.

7. Joystick comprising a stick (12) movable in relation to a base (11) at least in rotation around two axes, and first return means mounted between said base (11) and a movable element acting on said stick (12), tending to return said stick (12) to a neutral position, characterized in that it comprises means of compensation, mounted between said base (11) and said movable element, and applying on the latter a force compensating at least partially the force applied by said first return means, at least when said stick (12) is located in the vicinity of said neutral position, the joystick further characterized in that it comprises at least one ball and socket joint comprising two ball and socket joint elements substantially of the same radius, i.e. a head (21) and a small cup (22), with one of the elements able to pivot around the center of the other element, a first of said ball and socket joint elements being fixed in relation to said base (11) and having an inside space, and a second of said ball and socket joint elements being integral with said stick, and in contact with said movable element.

8. Joystick according to claim 7, characterized in that said stick (12) has an extension (25) penetrating into said inside space, the lower end of said extension (25) of said stick displacing in said inside space and carrying at least one sensor (27) and/or at least one magnet (26) of a unit for detecting movement by Hall effect.

9. Joystick according to claim 7, characterized in that it comprises a tipping (210) part mounted pivotingly in said inside space on two bearings (31, 32), and cooperating with said extension (25).

10. A method of manufacture of a joystick comprising:

obtaining a lower portion of a base and a stick;

setting up a first return means or a means of compensation;

setting up a movable element;

setting up the other of said means of compensation or said first return means such that the means of compensation reduces a force required to move the stick near a neutral position of the stick;

closing said base, in relation to an upper portion of said base and attaching of said upper portion of said base to a lower portion of said base.

* * * * *